US010583443B2

(12) United States Patent
Bauer et al.

(10) Patent No.: US 10,583,443 B2
(45) Date of Patent: Mar. 10, 2020

(54) SCREW OF A SOLID BOWL SCREW CENTRIFUGE

(71) Applicant: Flottweg SE, Vilsbiburg (DE)

(72) Inventors: Georg Bauer, Geisenhausen (DE); Daniel Neudecker, Mauern (DE); Manfred Schlarb, Vilsbiburg (DE); Benno Vielhuber, Vilsbiburg (DE)

(73) Assignee: FLOTTWEG SE (DE)

( * ) Notice: Subject to any disclaimer, the term of this patent is extended or adjusted under 35 U.S.C. 154(b) by 347 days.

(21) Appl. No.: 15/500,937

(22) PCT Filed: Jun. 18, 2015

(86) PCT No.: PCT/DE2015/100244
§ 371 (c)(1),
(2) Date: Feb. 1, 2017

(87) PCT Pub. No.: WO2016/019944
PCT Pub. Date: Feb. 11, 2016

(65) Prior Publication Data

US 2018/0178223 A1 Jun. 28, 2018

(30) Foreign Application Priority Data

Aug. 5, 2014 (DE) ..... 10 2014 111 104

(51) Int. Cl.
*B04B 1/20* (2006.01)

(52) U.S. Cl.
CPC ..... *B04B 1/20* (2013.01); *B04B 2001/2058* (2013.01)

(58) Field of Classification Search
CPC ..... B04B 1/20; B04B 2001/2058
USPC ..... 494/50, 53, 55, 58, 59, 66, 76, 78, 79
See application file for complete search history.

(56) References Cited

U.S. PATENT DOCUMENTS

| | | | | |
|---|---|---|---|---|
| 4,585,551 | A | 4/1986 | Musselmann et al. | |
| 5,261,869 | A * | 11/1993 | Caldwell | B04B 1/20 494/54 |
| 5,378,364 | A | 1/1995 | Welling | |
| 6,605,029 | B1 * | 8/2003 | Koch | B04B 1/20 494/53 |
| 8,511,476 | B2 | 8/2013 | Cassani | |
| 2013/0153471 | A1 * | 6/2013 | Cassani | B03B 5/32 209/162 |

FOREIGN PATENT DOCUMENTS

| | | | |
|---|---|---|---|
| DE | 10 2012 004 544 | 9/2013 | |
| EP | 0 094 022 | 11/1963 | |
| WO | 94/06536 | 3/1994 | |
| WO | 02/18055 | 3/2002 | |
| WO | 2012/014031 | 2/2012 | |
| WO | WO-2012014031 A1 * | 2/2012 | B03B 5/32 |

OTHER PUBLICATIONS

International Search Report dated Oct. 6, 2015.

* cited by examiner

*Primary Examiner* — Walter D. Griffin
*Assistant Examiner* — Shuyi S. Liu
(74) *Attorney, Agent, or Firm* — Gerald E. Hespos; Michael J. Porco; Matthew T. Hespos

(57) ABSTRACT

The invention relates to a screw (30) of a solid bowl centrifuge (10), comprising a screw hub (32) extending along a longitudinal axis (12), and a screw flight (34) surrounding the screw hub; the screw hub (32) is provided with a lattice structure (56) in a section (36) of the longitudinal extension thereof.

3 Claims, 6 Drawing Sheets

SCREW OF A SOLID BOWL SCREW CENTRIFUGE

BACKGROUND

1. Field of the Invention

The invention relates to a screw of a solid-bowl screw centrifuge having a screw hub extending along a longitudinal axis and a screw helix surrounding the screw hub. The invention further relates to a use of such a screw in a solid-bowl screw centrifuge.

2. Description of the Related Art

Solid-bowl screw centrifuges are characterised by a drum with a closed or solid bowl. The drum is rotated at high speed, whereby a multiphase mixture situated in the drum can be separated into at least a heavy phase and light phase. The heavy phase is normally a solid phase which is conveyed out of the drum by means of screw. For this purpose, the screw is mounted in the drum rotatably relative thereto and has a screw helix which is arranged around a screw hub. The screw helix sweeps along the inner surface or inner lateral surface of the drum and thus conveys the material of the heavy phase to an axial end region of the drum and there in particular out of a discharge cone. The multiphase mixture to be clarified is thus situated between the inner surface of the drum and the screw hub.

In certain solid-bowl screw centrifuges, a large pond depth is desired, in particular for clarifying reasons. At the same time, however, the pond depth is limited by the diameter of the screw hub and the buoyancy and deposition effects of the mixture or the light phase to be clarified, which result there.

The diameter of the screw hub cannot be reduced to an unlimited degree, since this would negatively affect the rigidity of the screw and its stability.

The object of the invention is to provide a solid-bowl screw centrifuge having a screw, the screw hub of which can be immersed in the mixture to be separated, without disadvantages regarding the rigidity and also aforementioned buoyancy and depositions resulting.

SUMMARY

This object is achieved according to the invention with a screw of a solid-bowl screw centrifuge having a screw hub extending along a longitudinal axis and a screw helix surrounding the screw hub, wherein the screw hub is designed with a grid structure in a portion of its longitudinal extent.

In the screw of a solid-bowl screw centrifuge according to the invention, its screw hub or screw body is designed in portions with a grid structure. This grid structure is in principle not closed to the outside, but open and can accordingly be immersed in the pond of the mixture to be clarified circulating in the drum, without problems arising due to buoyancy forces. With the configuration of the grid structure according to the invention, it can be achieved that settling particles which settle from the mixture to be clarified in the direction of the drum inner surface do not adhere to the grid structure. Rather, such particles slide off the grid structure according to the invention radially outwards or into the outer region of the drum. A further advantage of the screw hub according to the invention is that the region in which material to be clarified is released from an inlet pipe in the centre of the drum into the drum can be freely chosen in the axial direction.

In one embodiment, the screw hub has a cylindrical longitudinal portion and at least one conical longitudinal portion. The portion of the screw hub that has a grid structure may be the cylindrical longitudinal portion. The grid structure according to the invention is situated, in this development, in a cylindrical longitudinal portion of the screw and can be produced there accordingly particularly easily and inexpensively.

The conical longitudinal portion of the screw hub may have a closed lateral surface. The conical longitudinal portion that has a closed lateral surface is particularly easy to produce and gives the screw according to the invention high rigidity. The conical longitudinal portion may be of hollow and fluid-tightly closed design, so that no material that is to be or has been clarified can penetrate into its interior.

The screw hub may have at least one longitudinal portion comprising a screw bearing, and this portion of the screw hub may have a closed lateral surface. In this development, the screw bearing is surrounded by a closed lateral surface and accordingly is mounted particularly rigidly mounted, and at the same time is protected from an ingress of material that is to be or has been clarified into its inner bearing region.

The grid structure may have at least one transverse disc that may extend in the shape of an annular disc over the entire circumference of the screw hub.

In one embodiment, the grid structure has at least one longitudinal bar that extends over a transverse disc and may extend over the entire length of the portion in the longitudinal direction. Such longitudinal bars are easy to process and provide an advantageous base frame for the subsequent mounting of a screw hub on the screw hub according to the invention.

In one embodiment, the grid structure has at least one inclined strut that extends oblique to the longitudinal axis between two transverse discs. Such inclined struts can be mounted fixedly with high rigidity between the two transverse discs, in particular by a welded connection. Such connections can be produced very easily, because easily shaped contact surfaces result on the transverse discs.

The inclined strut may project at its end into the adjacent transverse disc. With the projection of the inclined strut into the associated transverse disc, there also results a form-fitting connection, by means of which in particular the grid structure can also be prepositioned.

In one embodiment, a total of three inclined struts are distributed and spaced equally over the circumference of the screw hub. With the three inclined struts, there results surprisingly an advantageous optimum with regard to many factors, such as cost, producibility, rigidity, fatigue strength and functionality with respect to the immersion in the pond.

The invention is also directed to a use of such a screw according to the invention in a solid-bowl screw centrifuge.

DETAILED DESCRIPTION

Figure 1:
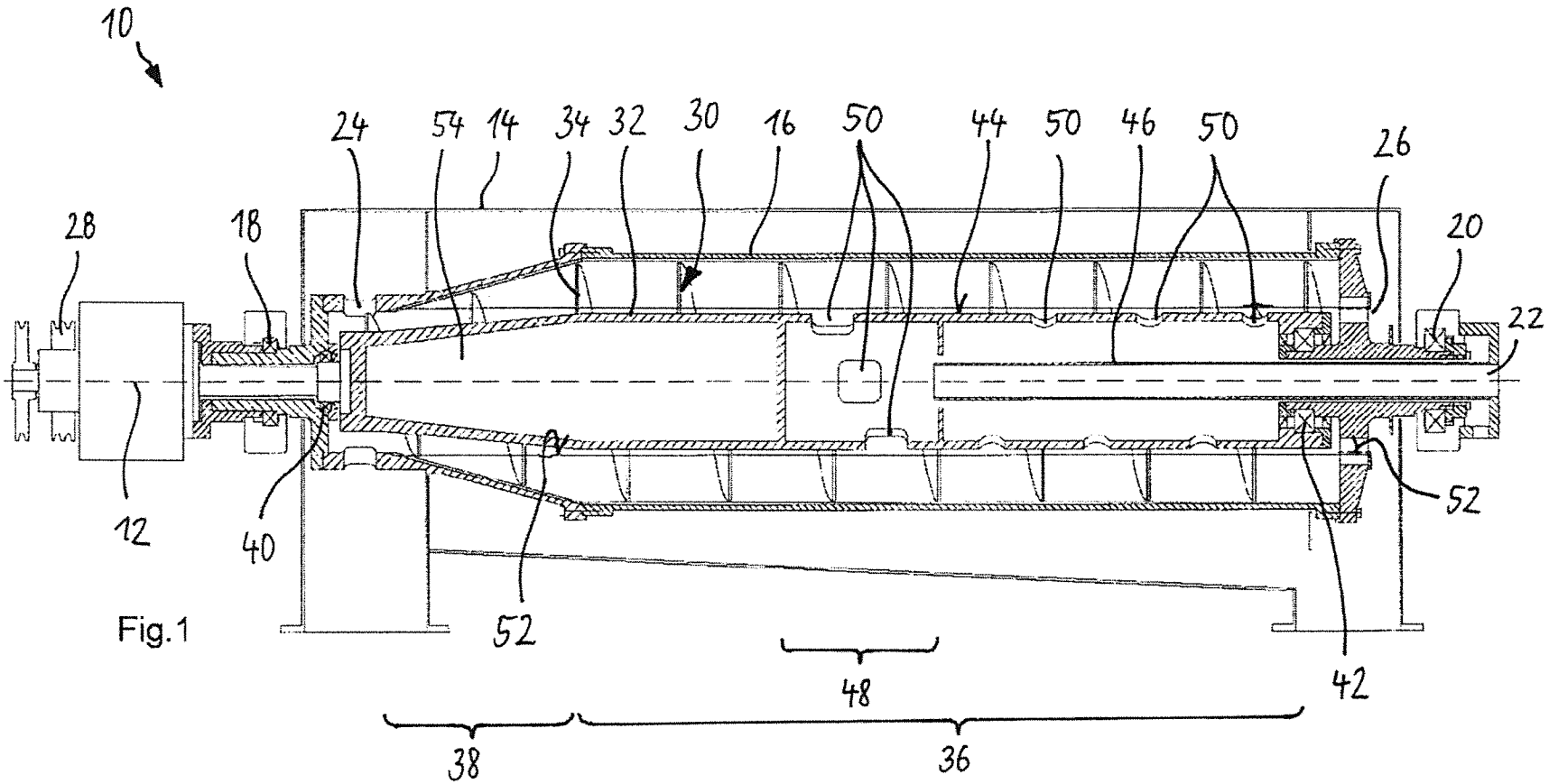
FIG. 1 shows a longitudinal section through a solid-bowl screw centrifuge according to the prior art.
Figure 2:
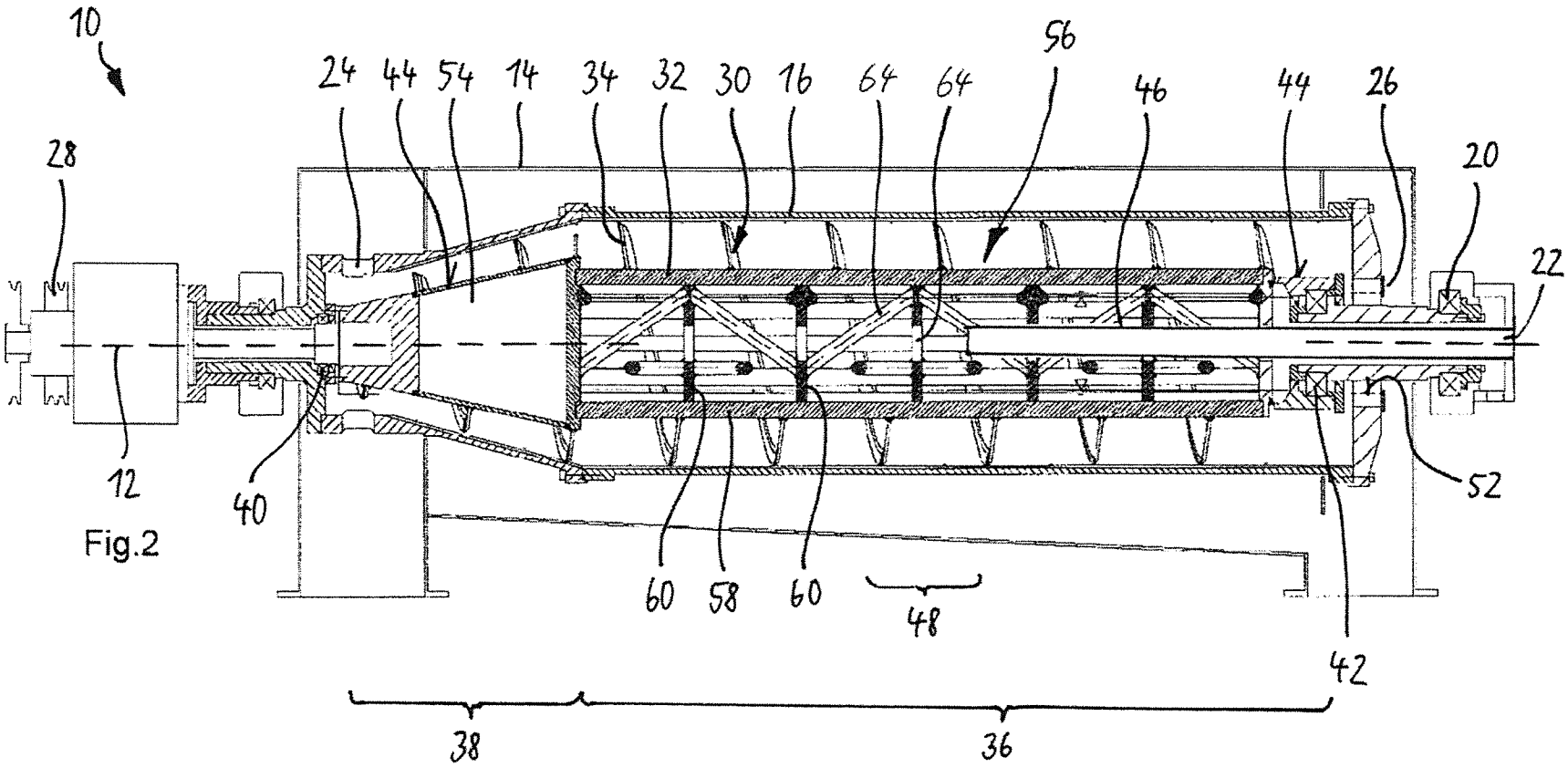
FIG. 2 shows a longitudinal section through a solid-bowl screw centrifuge according to the invention having a screw which is designed, in a portion of its longitudinal extent, with a grid structure.
Figure 3:
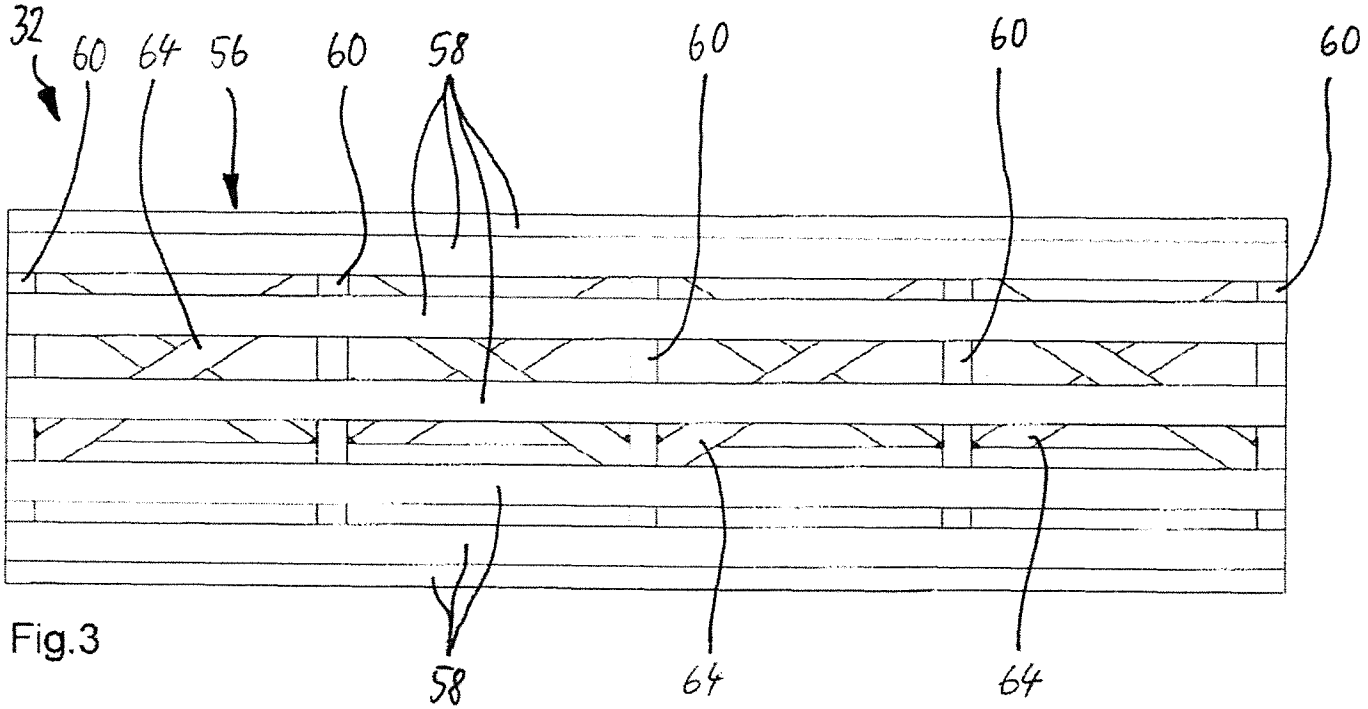
FIG. 3 shows a side view of the grid structure according to FIG. 2 with longitudinal bars, transverse discs and inclined struts.
Figure 4:
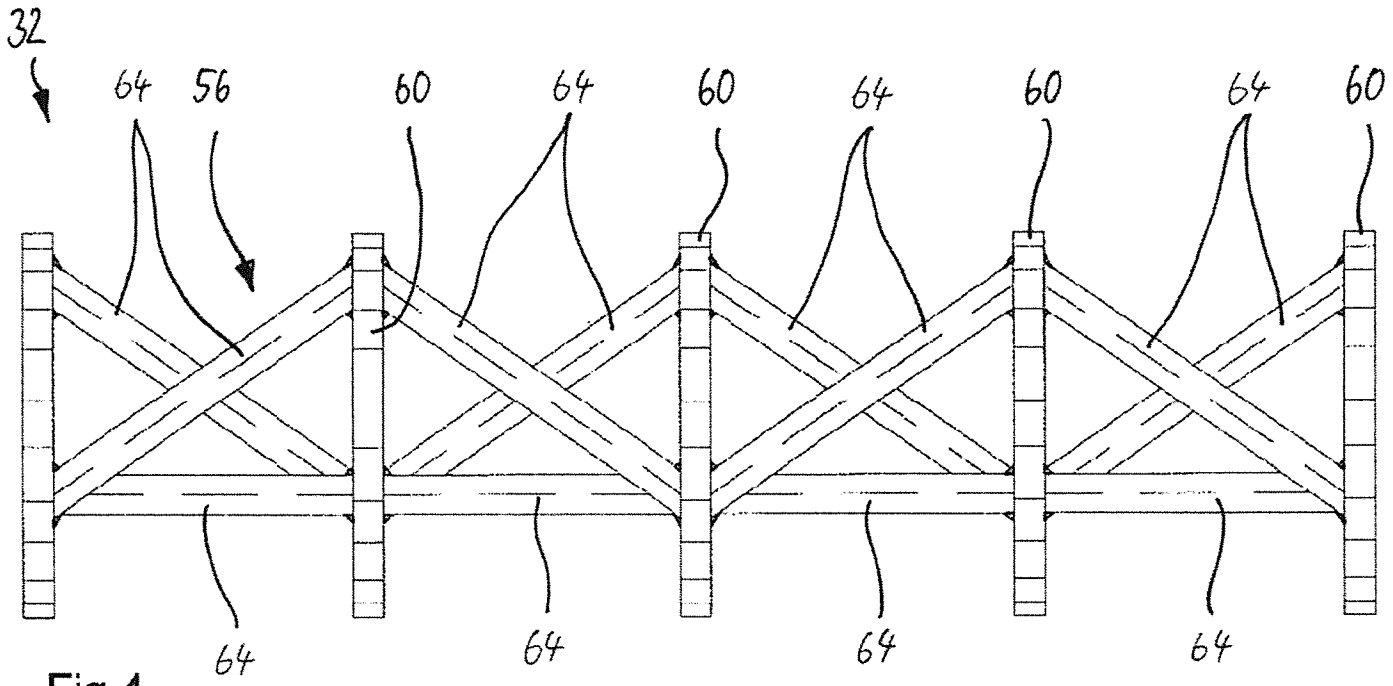
FIG. 4 shows the view according to FIG. 4 of the grid structure with the longitudinal bars omitted.

In the figures there is depicted a solid-bowl screw centrifuge 10 that extends substantially along a horizontal longitudinal axis 12. The solid-bowl screw centrifuge 10 has an outer housing 14, in which a drum 16 is mounted rotatably about the longitudinal axis 12. By rotating the drum 16 at a high rotational speed, a centrifugal force can be generated therein, by means of which a material to be clarified can be separated into a heavy and a light phase. For this purpose, the drum 16 is supported at a first drum bearing 18 and a second drum bearing 20.

On the drum 16 there is formed an inlet 22 for the material to be clarified as well as an outlet 24 for the heavy phase and an outlet 26 for the light phase. To rotate the drum 16 there is provided a drive 28. The outlet 26 acts as an overflow for the light phase situated radially inwards in the drum 16, so that this phase flows out automatically there provided that a predetermined level, the so-called pond depth, is reached in the drum 16. In order to be able to discharge from the drum 16 the heavy phase situated radially outwards in the drum 16, a screw 30 is provided in the drum 16. The screw 30 is rotated by the drive 28 relative to the drum 16 and the material of the heavy phase is thereby discharged along a cone, formed on the drum 16, radially inwardly and thus to the outlet 24.

For this purpose, the screw 30 has a screw hub 32 that extends along the longitudinal axis 12 and is surrounded radially outwards by a screw helix 34. The screw hub 32 thus serves to support the screw helix 34 in the radial direction, to transmit torque from the drive 28 to the screw helix 34 and in doing so to take up in particular tensile forces and shearing forces.

For this purpose, the screw hub 32 has a cylindrical longitudinal portion 36 and an axially adjoining conical longitudinal portion 38. The screw hub is mounted rotatably by a first screw bearing 40 and a second screw bearing 42. As can be readily seen in FIG. 1, in a screw hub 32 according to the prior art, over its entire longitudinal extent, i.e. both in the cylindrical longitudinal portion 36 and in the conical longitudinal portion 38, its lateral surface 44 is designed substantially closed or covering the whole area by a metal plate or a tubular surface. Only where an inlet pipe 46 for supplying material to be clarified ends centrally in an inlet region 48 into the interior of the screw hub 32 are there provided individual openings 50 in the lateral surface 44, through which the material to be clarified can flow radially outwards. Furthermore, individual openings 50 are provided in the cylindrical portion of the screw hub 32 according to FIG. 1 surrounding the inlet pipe 46. Material that may unintentionally have gotten into the end of the inlet pipe 46 in this inner part of the screw hub 32 can flow out of this inner part radially outwards. Furthermore, a relatively large fluid-tight space 54 is situated in the interior of the screw hub 32 axially opposite the inlet pipe 46. This space is intended to prevent any material to be clarified from getting into the interior of the screw hub 32 at all. At the same time, however, this relatively large fluid-tight space 54 also causes large buoyancy forces if the screw hub 32 is to be immersed in the material to be clarified. With such a construction the screw hub 32 must not be permanently immersed in the material to be clarified.

Consequently, a pond depth 52 of this solid-bowl screw centrifuge 10 according to the prior art is substantially limited by the outer radius or the outer diameter of the screw hub 32 to a relatively large radius or diameter.

Illustrated in FIGS. 2 to 7 are exemplary embodiments of solid-bowl screw centrifuges 10 that make it possible and that also are provided for permanently immersing the screw hub 32 in the material to be clarified. In this solid-bowl screw centrifuge the associated screw hub 32 is designed in the cylindrical longitudinal portion 36 and specifically exclusively in this portion with a grid structure 56.

The grid structure 56 in the present case is designed by means of twelve longitudinal bars 58 that are arranged over the circumference of the screw hub 32 in the longitudinal direction thereof, i.e. distributed parallel to the longitudinal axis 12 at equal spacings. The preferred number, according to the invention, of longitudinal bars 58 lies between eight and sixteen, in particular between ten and fourteen. The longitudinal bars 58 form radially outwards in each case a bearing surface for the screw helix 34 and are supported radially inwards on transverse discs 60. The longitudinal bars 58 extend over the transverse discs 60 which are oriented transversely to the longitudinal axis 12 and thus form an inner support for the longitudinal bars 58. The transverse discs 60 are designed, radially inwards by means of a central open 62, hollow in the form of an annular disc, so that in particular also the inlet pipe 46 can extend through them.

Between each two transverse discs 60 there extend between two and six inclined struts 64. In the exemplary embodiment according to FIGS. 5 and 6, there are three inclined struts 64, and, in the exemplary embodiment according to FIG. 7, there are four inclined struts 64. These inclined struts 64 are inclined with respect to the longitudinal axis at an angle of between 30° and 40°, preferably between 33° and 37°, in the present case 35°, and at their ends are each bevelled and welded to the adjacent transverse disc 60. The respective inclined strut 64 preferably projects into a recess (not shown) on the transverse disc 60. By means of this recess the inclined strut 64 is advantageously coupled in a form-fitting manner to the transverse disc 60 and for the assembly of the grid structure, which given the required low dimensional tolerances is quite difficult, can be positioned easier and more precisely.

Figure 5:
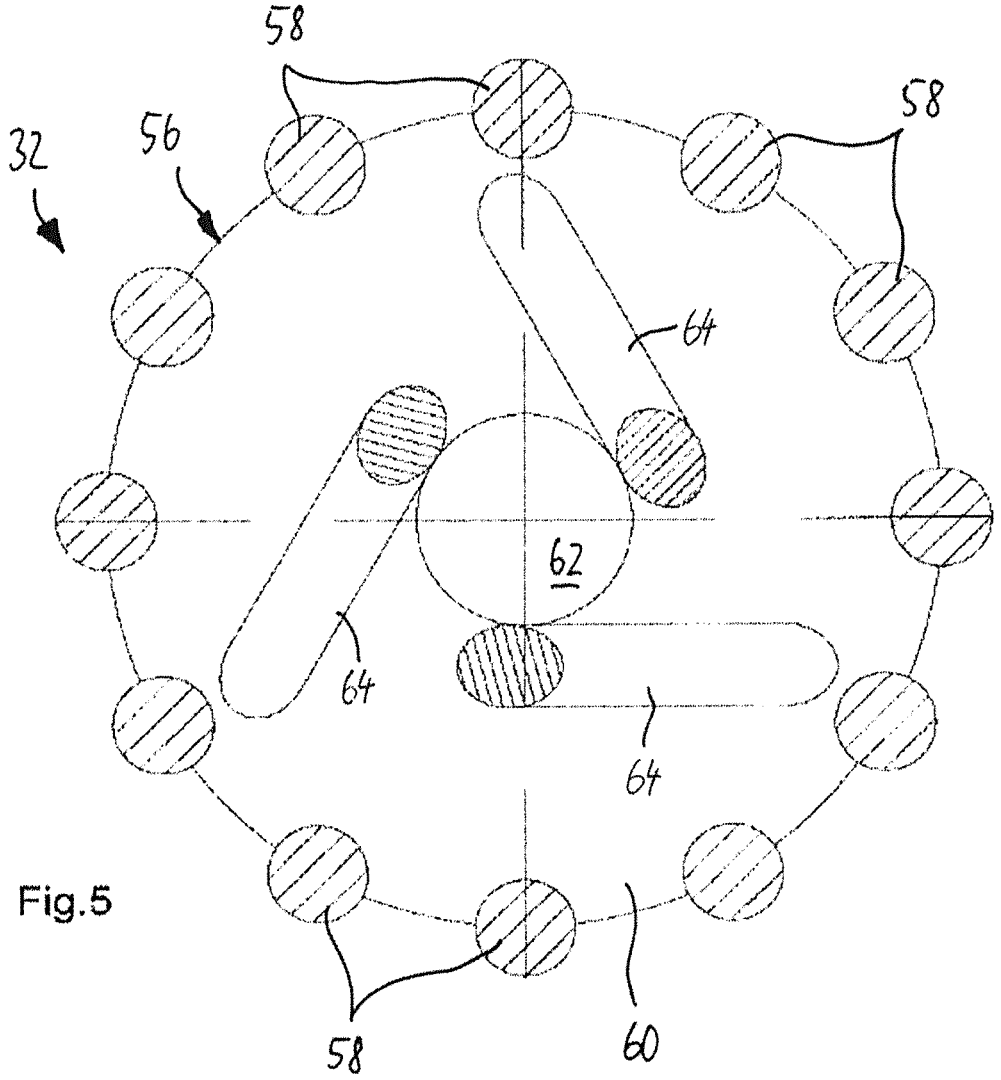
FIG. 5 shows the section V-V according to FIG. 3 in an enlarged representation.
Figure 6:
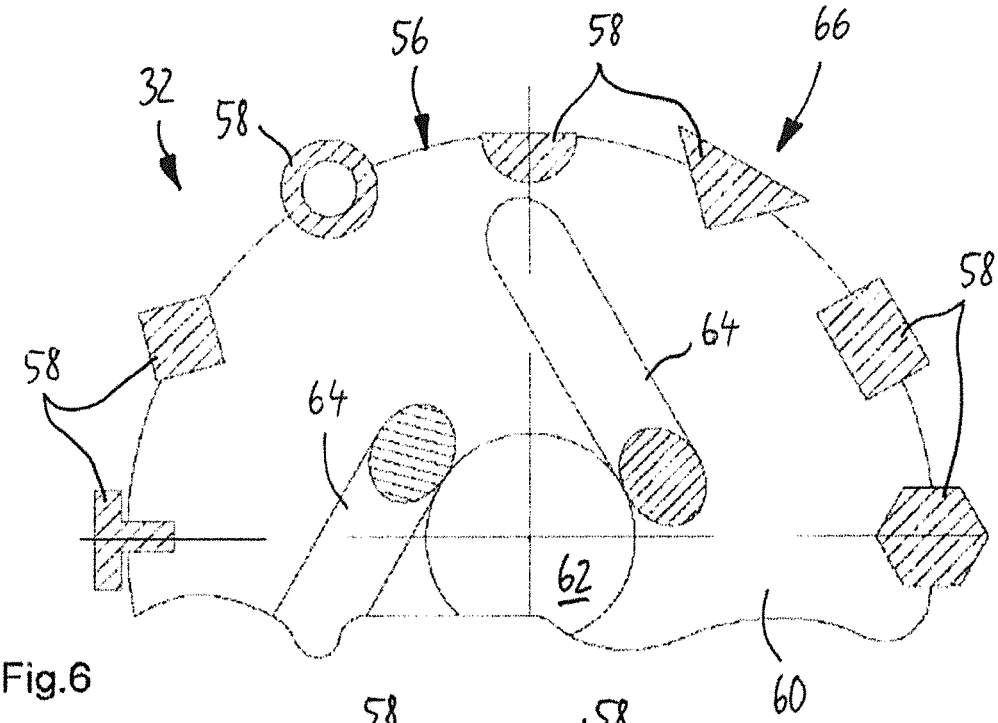
FIG. 6 shows the section according to FIG. 5 with alternative longitudinal bars.
Figure 7:
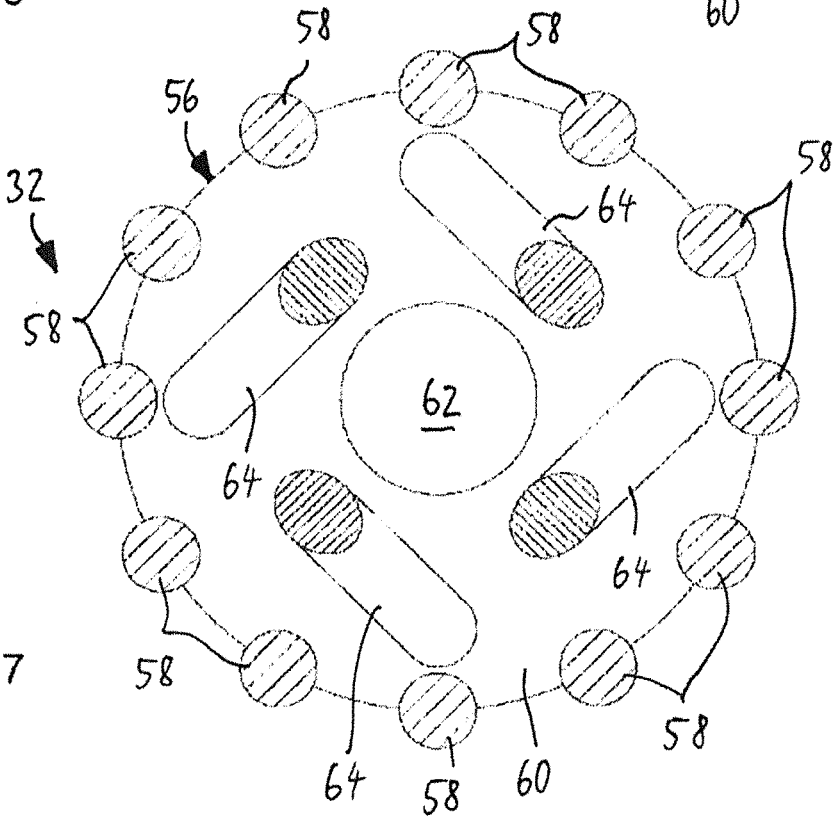
FIG. 7 shows the section according to FIG. 5 in an alternative configuration.

In addition to the longitudinal bars 58 and inclined struts 64 which in FIGS. 5 and 7 are each of round and solid form in cross-section, various advantageous cross-sectional shapes 66 for the longitudinal bars 58 are illustrated in FIG. 6. A hexagonal shape is advantageous in view of a uniform bending moment distribution and furthermore an outflow of material from radially inwards to radially outwards. A rectangular shape is advantageous in view of the two bending moments of different size in the radial direction and in the circumferential direction which are thereby achieved. A triangular shape is advantageous because a wide radially outer area for the screw helix 34 results and yet material can easily flow out from inside towards the outside. With regard to these properties, a semi-circular shape is a good compromise, since semi-circular material can be obtained far more cost-effectively. By means of a hollow shape, in particular a circular tube shape, high bending moments with low material requirement and low weight can be achieved. A square shape is inexpensive to obtain and is advantageous precisely when two of the corners are aligned in the radial direction.

The diagonal bending moment axes of this shape are then also advantageously used. By means of a T-shape a wide contact surface for the screw hub 32 can also be provided radially outwards.

In conclusion, it should be noted that all the features which have been mentioned in the application documents and in particular in the dependent claims, despite their formal dependence on one or more specific claims, should also be accorded independent protection individually or in an any arbitrary combination.

LIST OF REFERENCE NUMERALS

10 solid-bowl screw centrifuge
12 longitudinal axis
14 outer housing
16 drum
18 first drum bearing
20 second drum bearing
22 inlet for material to be clarified
24 outlet for heavy phase
26 outlet for light phase
28 drive
30 screw
32 screw hub
34 screw helix
36 cylindrical longitudinal portion
38 conical longitudinal portion
40 first screw bearing
42 second screw bearing
44 closed lateral surface
46 inlet pipe
48 inlet region
50 opening in the lateral surface
52 pond depth
54 fluid-tight space
56 grid structure
58 longitudinal bar
60 transverse disc in the shape of an annular disc
62 central opening
64 inclined strut
66 cross-sectional shape of the longitudinal bars

The invention claimed is:

1. A screw of a solid-bowl screw centrifuge, comprising: a screw hub (32) extending along a longitudinal axis (12); and a screw helix (34) surrounding the screw hub (32), wherein the screw hub (32) has a grid structure (56) in a portion (36) of a longitudinal extent of the screw hub (32), and wherein the grid structure (56) has at least one inclined strut (64) that extends oblique to the longitudinal axis (12) between two transverse discs (60).

2. The screw of a solid-bowl screw centrifuge claim 1, wherein the inclined strut (64) projects at its end into an adjacent transverse disc (60).

3. The screw of a solid-bowl screw centrifuge of claim 1 wherein the at least one inclined strut (64) comprises three inclined struts (64) equally spaced over the circumference of the screw hub (32).

* * * * *